US006164997A

United States Patent [19]

Davies

[11] Patent Number: 6,164,997

[45] **Date of Patent: *Dec. 26, 2000**

[54] ANTENNA CONNECTOR ARRANGEMENT

[75] Inventor: David Paul Davies, Torquay, United Kingdom

[73] Assignee: Nortel Networks Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/167,030

[22] Filed: Oct. 6, 1998

[51] Int. Cl.[7] ..... H01R 4/38

[52] U.S. Cl. ..... 439/320; 439/274

[58] Field of Search ..... 439/320, 321, 439/322, 323, 271, 272, 273, 274, 275, 277, 367, 368, 521, 916, 278, 279, 281, 587, 588, 589

[56] References Cited

U.S. PATENT DOCUMENTS

| | | | |
|---|---|---|---|
| 4,804,339 | 2/1989 | Cohen | 439/588 |
| 4,810,208 | 3/1989 | Hayes et al. | 439/589 |
| 5,607,320 | 3/1997 | Wright | 439/394 |

*Primary Examiner*—Paula Bradley
*Assistant Examiner*—Ross Gushi
*Attorney, Agent, or Firm*—Lee, Mann, Smith, McWilliams, Sweeney & Ohlson

[57] ABSTRACT

An arrangement for protecting a multi-port electrical connection between a component housed in a housing part and a cable from its environment, for example from varying weather conditions. The arrangement comprises a single piece tube like adapter, said adapter having a non-uniform internal cross-sectioned portion for receiving a first electrical connection part in a single predetermined orientation and an internal circumferential seal for sealing against the cable passing through said adapter and connected to the first electrical connection part. The arrangement additionally comprises an external surface portion of non-uniform cross-section locatable within a receiving recess of the housing part in a single predetermined orientation and an external circumferential seal for sealing against a part of the receiving recess. The arrangement acts so that the adapter is fixable within the housing part so as to align the first electrical connection part housed in the adapter with respect to a second electrical connection part housed in the housing so as to form the multi-port electrical connection and so as to provide an environmental seal between the cable and the housing part. In this way the adapter provides an environmental seal between the cable and the antenna housing while ensuring the correct orientation of the first and second electrical connectors.

17 Claims, 6 Drawing Sheets

ANTENNA CONNECTOR ARRANGEMENT

FIELD OF THE INVENTION

The present invention relates to easy assembly multi-port electrical connections which have to withstand several years of poor environmental conditions, such as varying weather conditions. In particular, the present invention relates to an arrangement for housing a multi-port electrical connection used for connecting a housing part, such as an antenna unit located on the outside of a building, to a multi-wire cable, for example, a cable which passes into the building for connection to a receiver modem unit of a fixed wireless access communications system.

Currently used multi-port electrical connectors, such as the prior art connector (100) shown in FIG. 10 require the individual connection of each wire of the multi-wire cable to a dedicated connecting pin before the wires can be individually electrically connected via the connecting pins to a socket housing (102) of the connector (100). Each wire of the cable has to be individually stripped of its insulating sleeve at its end and then has a connector pin crimped over its end using a special crimping tool. Then each crimped connector pin is individually inserted into a separate socket of the socket housing (102) according to colour coding of the wires of the cable and sockets of the socket housing (102). Thus, currently it is a complex, time consuming procedure to attach an antenna unit to a multi-wire cable. Care has to be taken to ensure that a good electrical connection is made between each wire and each crimped connector pin because sometimes the connector pins can be crimped over the wire insulation sleeve and not the wire itself. Further care has to be taken to ensure that the correct colour coded wire is fitted into the correct colour coded socket of the socket housing (102).

The antenna and cable are generally located externally, in unsheltered positions, in the external environment and so the connectors, such as connector (100) between the antenna and cable are designed to withstand many years of weather conditions, in particular prolonged exposure to rain, snow, solar radiation, varying temperatures and humidity and wind-induced abrasion. Therefore, substantial weatherproofing and cable strain relief is required to meet these high standards.

In the prior art arrangement, the socket housing (102) of the multi-port connector (100) into which the crimped connector pins are fitted at end (108) as described above has a further set of sockets (104) located at an opposite end of the socket housing (102) which can be fitted to the multiple pins of a multi-pin connector mounted on a printed circuit board located within an antenna housing. The socket housing (102) of the connector is fitted into a receiving recess of the antenna housing in a correct alignment because of a plurality of non-uniformly distributed splines (106) which are located on the outer surface of the socket housing (102) and can be received in only one orientation within the receiving recess of the antenna housing which has a plurality of cooperating non-uniformly distributed grooves. The end (108) of the socket housing to which the cable wires are connected is fitted by a screw threaded connection (110,112) to a first end of a cylindrical body (114) which houses the cable. A bayonet connector sleeve (116) is located between the socket housing (102) and the cylindrical body (114) and is trapped therebetween by the screw thread connection (110,1 12).

The bayonet connector sleeve (116) fixes the multi-port connector (100) to the receiving recess of the antenna housing by a bayonet connection. Two rubber O-rings are used in this bayonet connection to provide weather proof sealing. Within the cylindrical body (114), directly bearing on the end (108) of the socket housing is located a metal washer (118), over which is fitted a rubber sealing grommet (120), over which is fitted a further metal washer (122). A screw threaded member (124) is then fitted to a second opposite end of the cylindrical body (114) by a screw thread connection (126) and acts so as to squeeze the grommet (120) so that the grommet provides a seal between the multi-wire cable passing through the cylindrical body (114) and the internal surface of the cylindrical body. The screw threaded member (126) itself comprises a cable engaging member (128) which engages around the outside of the cable. Finally, a cable gland (130) is fitted by a screw thread connection (132,134) to the opposite end of the screw threaded member (124) to press on the cable engaging member (128) and to provide cable strain relief.

Accordingly, in order to withstand poor environmental conditions currently used connectors have separate crimped pin connection assemblies, multiple separate environmental sealing assemblies, separate housing and connection assemblies and separate strain relief assemblies which leads to a complex multi-component, connector assembly which is expensive and difficult and time consuming to assemble.

OBJECT OF THE INVENTION

The object of the present invention is to provide an arrangement for protecting a multi-port electrical connection between a component housed in a housing part, such as an antenna housing, and a cable from its environment, for example from varying weather conditions, which overcomes at least some of the problems discussed above. In particular the present invention provides a simple and cheap to manufacture arrangement which is quickly and conveniently deployed and can provide good weather proofing, strain relief and accurate alignment for multi-port electrical connectors.

SUMMARY OF THE INVENTION

According to the present invention there is provided an arrangement for protecting a multi-port electrical connection between a component housed in a housing part and a multi-wire cable from its environment, wherein the arrangement comprises a single piece tube like adapter, said adapter having;

- a non-uniform internal cross-sectioned portion for receiving a first electrical connection part in a single predetermined orientation;
- an internal circumferential seal for sealing against a cable passing through said adapter and connected to a first electrical connection part;
- an external surface portion of non-uniform cross-section locatable within a receiving recess of the housing part in a single predetermined orientation;
- and an external circumferential seal for sealing against a part of the receiving recess, such that the adapter is fixable within the housing part so as to align a first electrical connection part housed in the adapter with respect to a second electrical connection part housed in the housing so as to form the multi-port electrical connection and so as to provide an environmental seal between a cable connected to a first electrical connection part and the housing part.

The arrangement according to the present invention serves a dual purpose.

Firstly, the adapter which is a single piece part, provides an environmental seal between a housing part, which may be part of an antenna housing located in an unsheltered position on an outside wall of a subscriber's premises, and a cable extending from the housing part, which protects the first and second electrical connection parts from poor environmental conditions.

These poor environmental conditions will generally be due to varying weather conditions to which the arrangement according to the present invention is exposed, for example, when it is used to connect an antenna housing mounted on the outside of a building to a cable. However, there are applications for using the arrangement according to the present invention inside a building or shelter to protect a multi-port electrical connection from poor environmental conditions within that building or shelter, such as high humidity.

The adapter has a internal circumferential seal, preferably forming part of the internal surface of the adaptor, for sealing against a cable which extends through the adapter and which, in use, is connected to a first electrical connection part housed within the adapter. To this end the internal circumferential seal of the adapter may be made of a resilient material, such as a plastics material, for example a rubber material. The adapter also has an external circumferential seal, preferably forming part of the external surface of the adaptor, for sealing against an internal surface of a receiving recess of the housing part. To this end the external circumferential seal of the adapter may be made of a resilient material, such as a plastics material, for example a rubber material. In order to improve the environmental seal between the adapter and the housing part it is preferred that the external circumferential seal of the adapter is at least 4 mm in length. In a preferred embodiment the single piece adapter is made of two joined parts comprising a first resilient part including the internal and the external circumferential seals and a second rigid part including the internal and external non-uniform cross sectioned portions. The rigid and resilient parts may be joined by forming the adapter in a two part moulding process.

Secondly, the adapter aligns a first electrical connection part connected to a cable relative to a second electrical connection part mounted and housed in the housing part and connects them to form the multi-port electrical connection housed by the arrangement according to the present invention. This is achieved by the adapter having a non-uniform internal cross sectioned portion for receiving a first electrical connection part in a predetermined orientation and by the adapter having a non-uniform cross sectioned external portion locatable within the receiving recess of the housing part in a single predetermined orientation. Accordingly, locating the adapter within the housing part in the predetermined orientation aligns a first electrical connector housed within the adapter with respect to a second electrical connector mounted within the housing part.

Preferably, the non-uniform internal cross sectioned portion of the adapter defines a keyway for receiving a cooperating key on a first electrical connection part. It is also preferred that the non-uniform external cross sectioned portion defines a non-uniform orientation surface (such as a flat surface provided on an otherwise cylindrical surface) locatable in a single predetermined orientation within the housing part which itself has a cooperating non-uniform orientation surface (such as a flat surface provided on an otherwise cylindrical surface).

In order to provide cable strain relief it is preferred that the arrangement according to the present invention additionally comprises a strain relief clamp formed with a channel for receiving a cable located within the adapter, for engaging a cable located within the adapter and for additionally engaging the adapter to urge the portion of the adapter comprising the inner circumferential seal against a cable located within the adapter. Preferably, the strain relief clamp comprises a plurality of resilient fingers for engaging a cable located within the adapter. Thus, as well as providing cable strain relief the strain relief clamp reinforces the environmental seal between the adapter and a cable located within the adapter. It is preferred that the strain relief clamp for engaging a cable located within the adapter, additionally engages the adapter to urge the portion of the adapter comprising the external circumferential seal against an internal surface of the receiving recess in order to reinforce the seal between the adapter and the receiving recess of the antenna housing.

It is also preferred that the arrangement according to the present invention additionally comprises a fixing member formed with a channel for receiving a cable located within the adapter, wherein the fixing member is fixable to a receiving portion of the housing part, such that when the fixing member is fixed to the receiving portion of the housing part the strain relief clamp is urged by the fixing member to engage a cable located within the adapter and to additionally engage the adapter to deform the portion of the adapter comprising the inner circumferential seal to reinforce the seal between the adapter and the cable. The cable strain can also or alternatively engage the portion of the adapter comprising the external circumferential seal in order to deform the adapter and reinforce the seal between the adapter and the receiving recess. The fixing member may have an externally screw threaded portion which is screw threadable to an internally screw threaded portion of the receiving recess of the housing part.

Preferably, the first and second electrical connection parts comprise mating multi-port electrical connectors. Thus, standard mating multi-port electrical connectors, such as insulation displacement connectors, can be adapted using the arrangement according to the present invention for use in areas which are exposed to poor environmental conditions.

Preferably, the housing part forms part of an antenna assembly which is mountable in an external environment, for example on the outside of a building where it is exposed to the weather.

According to a second aspect of the present invention there is provided a method of assembling an arrangement for protecting a multi-port electrical connection between a component housed in a housing part and a multi-wire cable from its environment, comprising the steps of;

threading the cable through a tube shaped adapter, electrically connecting the cable to a first electrical connection part, locating the first electrical connection part within the adapter in a predetermined orientation defined by a non-uniform internal cross sectioned portion of the adapter and a cooperating non-uniform external cross sectioned portion of the first electrical connector, and locating the adapter within a recess in the housing part in a predetermined orientation defined by a non-uniform external surface portion of the adapter and a non-uniform internal surface portion of the recess, said adapter having an external circumferential seal for sealing against an internal surface portion of the recess and an internal circumferential seal for sealing against the cable.

Preferably the method additionally comprises the step of threading the cable through a strain relief clamp such that the clamp engages the cable and engages the portion of the adapter comprising the internal and/or the external circumferential seal to urge the adapter to seal against the cable and/or the receiving recess of the housing part.

Preferably the method additionally comprises the steps of;

threading the cable through a strain relief clamp, threading the cable through a fixing member, and fixing the fixing member to a receiving portion of the externally located housing part such that the fixing member urges the strain relief clamp to engage and clamp the cable and to engage the portion of the adapter comprising the internal and/or the external circumferential seal to urge the adapter to seal against the cable and/or the receiving recess of the housing part.

BRIEF DESCRIPTION OF THE DRAWINGS

In order that the present invention is more fully understood and to show how the same may be carried into effect, reference shall now be made, by way of example only, to the figures as shown in the accompanying drawing sheets, wherein:

As shown in FIG. 8, an antenna comprising a housing (40) is mounted in an external unsheltered environment, for example on the outside wall (43) of a building (41) (shown with the walls of the building partially cut away). An externally located cable (6) extends from the antenna housing (40), along the outside of the building and then into the building for connection to a receiver modem unit (45). Thus, signals received by the antenna (40) are demodulated from a radio frequency carrier and sent via the cable (6) to the subscriber's receiver modem unit (45). Similarly, signals generated within the building (41) and sent from the receiver modem unit (45) to the antenna via cable (6) are modulated onto a radio frequency carrier and transmitted by the antenna (40).

FIG. 1 shows a part of an arrangement (2) according to the present invention. It houses a standard eight-port digital socket (4), which is an insulation displacement connector suitable only for internal use, ie. for use within a dry and sheltered indoor environment. The standard socket (4) is connected in a standard way (as discussed below) to a cable (6) which carries eight wires which are connected to a respective one of the eight ports of the socket (4). The socket (4) is formed in two parts (4*a*) and (4*b*). The eight wires extending from the end (23) of the cable (6) are threaded into an appropriate one of eight receiving through holes (not shown) of the socket part (4*a*) and are then folded through 90° so that they extend out of respective guiding recesses (eg.4*c*) provided in an end surface of the socket part (4*a*). The part (4*b*) is then located in the correct orientation over the part (4*a*) and is press fitted thereto, in a known way in a press fitting tool. The press fitting together of the parts 4*a* electrically connects each wire located in the part (4*a*) to a respective socket (56) of the part (4*b*) and trims the ends of the wires which extend from the guiding recesses (eg.4*c*).

Figure 2:
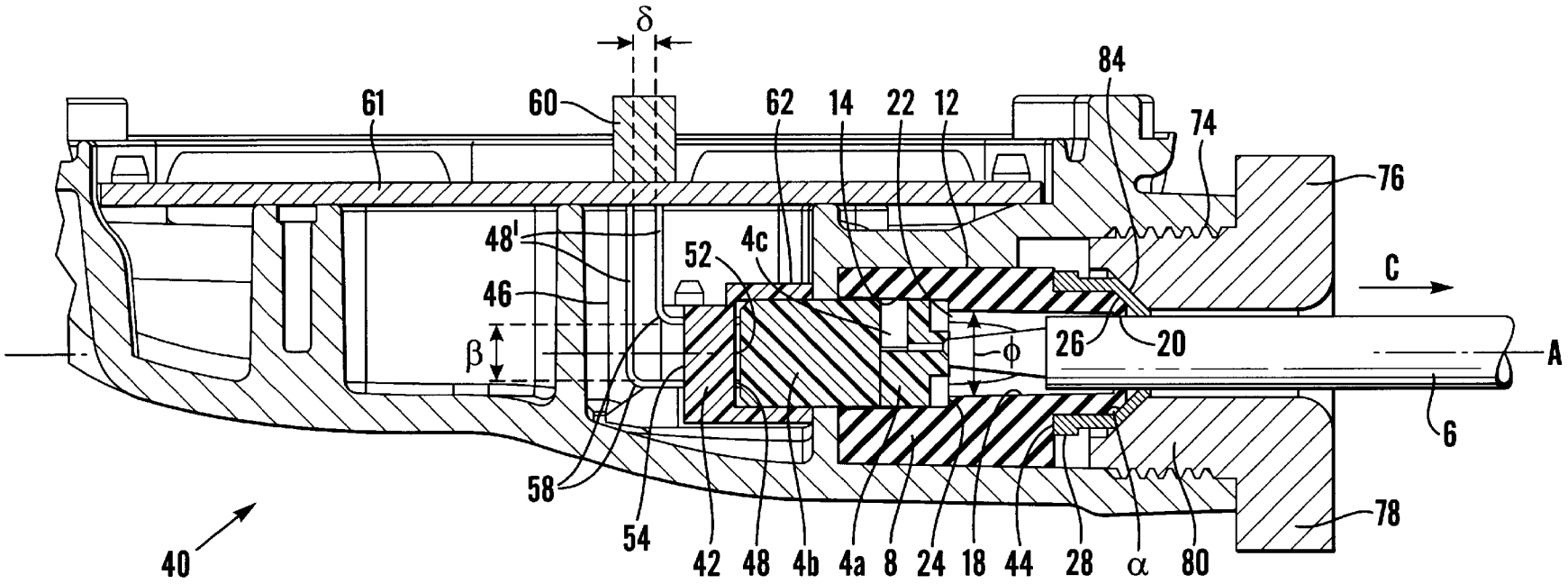
FIG. 2 shows a longitudinal cross section of the arrangement according to the present invention, part of which is shown in FIG. 1.

The arrangement (2) is used to connect the socket (4) to a standard eight port plug (42) in an antenna housing (40) (See FIG. 2).

The socket (4) has an orientation key (16) which enables it to be fitted with the correct orientation into a tube like dual purpose adapter (8) which has a corresponding keyway (10) formed in its internal surface. Clearly, alternative non-uniform socket and adapter shapes can be used to ensure the correct alignment of the socket (4) within the adapter (8). The dual purpose adapter (8) acts as an environmental sealing element for protecting the socket (4) from poor environmental conditions and as an orientation adapter for orienting the socket (4) correctly.

The adapter (8) may be made of a resilient plastics material, for example, a rubber material. Alternatively, only the sealing parts of the adapter (8) may be made of a resilient plastics material.

The adapter (8) has a flat orientation surface (12) which is used to orient the socket (4) relative to the multi-pin plug (42) within the antenna housing (40) as described below in relation to FIG. 2. Clearly, the adapter can be formed with alternative non-uniform external surface features in order to ensure correct alignment between the adapter and the plug, such as a keyway type arrangement.

Figure 3:
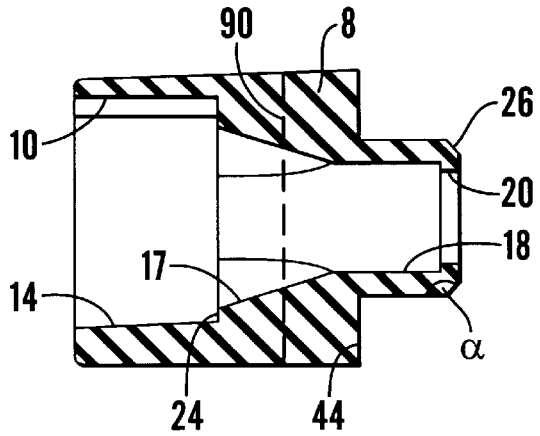
FIG. 3 shows a cross-section through a horizontal plane passing through axis (A) of FIG. 2 of a dual purpose adapter used in the arrangement of FIGS. 1 and 2.

FIG. 3 shows a cross-section of the adapter (8) through a horizontal plane passing through axis (A) of FIG. 2. The adapter (8) is tube like and has an internal channel which passes through the adapter, which channel comprises a forward rectangular cross-sectioned portion (14), an intermediate tapered portion (17), a rearward cylindrically cross-sectioned portion (18) and a sealing portion (20). At least the sealing portion (20) is made of a resilient plastics material. The socket (4) fits within the forward portion (14) of the adapter (8) with the key (16) fitting within keyway (10) and with the rearward end (22) of the socket (4) abutting a shoulder (24) between the forward portion (14) and the intermediate tapered portion (17) of the adapter (8) The intermediate tapered portion (17) tapers only across a horizontal plane (in the sense of FIG. 2) and as can be seen from FIG. 2 has a constant vertical width $\phi$. The intermediate portion (17) houses the eight wires which taper inwardly from the rear (22) of the socket (4) to the end (23) of the cable (6). The rearward cylindrically cross-sectioned portion (18) of the adapter (8) houses a portion of the cable (6) and the resilient circumferential sealing portion (20) engages around the entire circumference of the resilient external covering of the cable (6) to seal around the cable. It should be noted that the external surface of the most rearward part of the adapter (8) has an annular chamfer (26).

Figure 1:
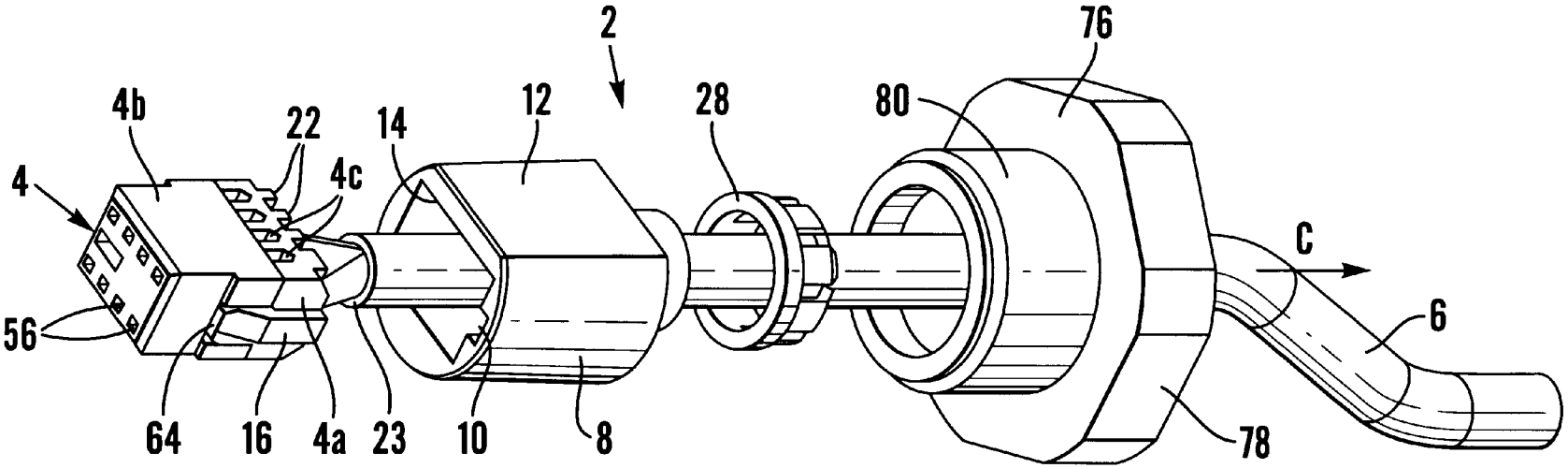
FIG. 1 shows an exploded diagram of part of an arrangement according to the present invention for an electrical multi-port connection.
Figure 4:
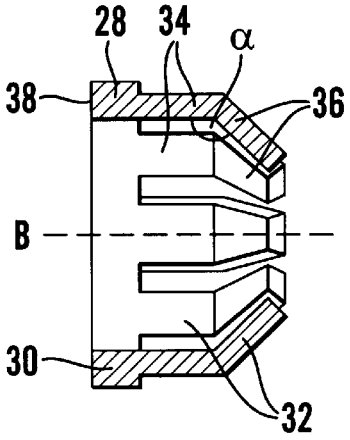
FIG. 4 shows a cross-section through a strain relief clamp used in the arrangement of FIGS. 1 and 2.

As can be seen from FIGS. 1 and 2, a strain relief clamp (28) is fitted over the cable (6) and over the rearward portion of the adapter (8). The strain relief clamp (28) is shown in more detail in FIG. 4 which shows a cross-sectional view of the clamp. The clamp (28) has a forward ring portion (30) from which extend a plurality of rearwardly directed resilient clamping fingers (32). Each finger (32) has an intermediate portion (34) adjacent to the ring portion (30) which has an internal surface located on the same cylindrical surface as the internal surface of the ring portion (30). Each finger (32) also has an end portion (36) which is bent inwardly at an angle ($\alpha$) towards the central axis (B) of the clamp (28). As is shown in FIG. 2, when the connector assembly according to the present invention is assembled, the ring portion (30) of the clamp and the intermediate portion (34) of the fingers (32) surround the external surface of the rearward portion of the adapter (8) and the front surface (38) of the ring portion (30) of the clamp (28) abuts a shoulder (44) provided on the external surface of the adapter (8). The internal surfaces of the end portions (36) of the fingers (32) follow the chamfer (26) on the rear portion of the adapter (8) and the ends of the end portions (36) of the fingers (32) grip the external surface of the cable (6) adjacent the rearward end of the adapter (8). Other types of cable clamping arrangements known to the person skilled in the art can be used, provided they can perform the dual function of clamping the cable and reinforcing the seal between the adapter and the cable.

Figure 5:
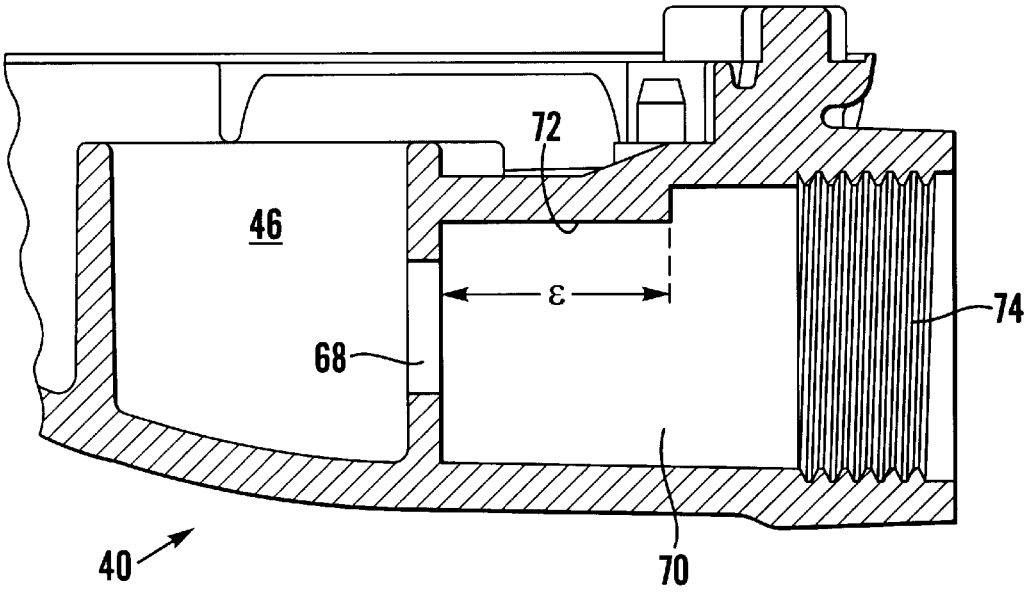
FIG. 5 shows an enlarged cross-section of a part of the antenna housing shown in FIG. 2.
Figure 6A:
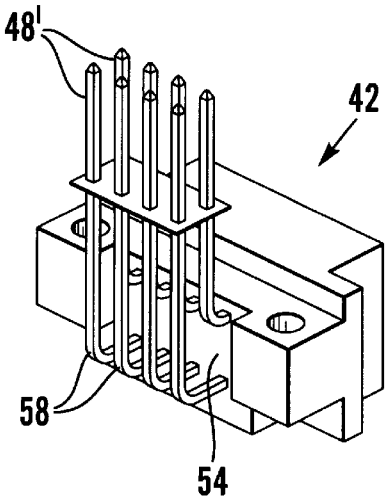
FIG. 6*a* shows a perspective view of the front of a multi-port electrical plug connector housed in the antenna housing shown in FIG. 2.
Figure 6B:
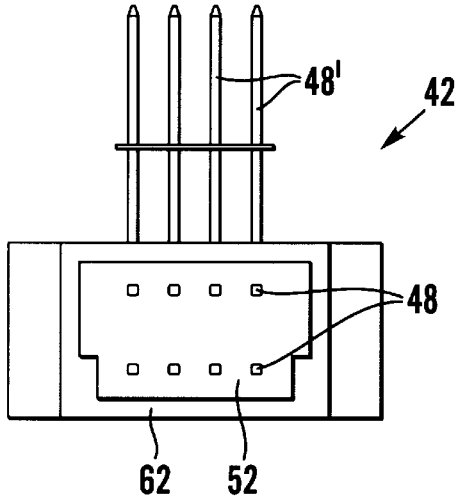
FIG. 6*b* shows a rear view of the plug of FIG. 6*a*.

A plug (42) shown in more detail in FIGS. 6A and 6B is located within a part of an antenna housing (40) which is shown in more detail in FIG. 5. The housing (40) has a first recess (46) within which the plug (42) is housed. The plug (42) has eight pins (48) which extend from the rearward part (52) of the body of the plug, through the body of the plug and also extend from the front part (54) of the body of the plug at (48'). The eight pins (48) which extend from the rearward part (52) of the body of the plug are spaced, in two rows of four pins so that they are engageable with the two rows of four holes (56) in the front surface of the socket (4) (See FIG. 1). The pins (48) extending from the rearward part (52) of the body of the plug (42) are protected by a sleeve (62) which extends from the rearward part (52) of the body of the plug (42). Thus, the front part of the socket (4) up to shoulder (64) can be slideably fitted within the sleeve (62) (as shown in FIG. 2) to fit the pins (48) extending from the plug (42) within the holes (56) in the socket (4).

In the embodiment shown there are two rows of four pins, however, there could be more or less rows and more or less pins in each row, depending on the number of wires carried within the cable (6). It should be noted that the spacing between the two rows of pins (48') extending from the front part (54) of the body of the plug (42) is changed by the 90° bends (58) in the pins (48'). The 90° bends in each row of pins (48') are arranged so that the vertical distance $\beta$ between the rows of pins is greater than the horizontal distance $\delta$ between the rows of pins. The ends of the pins (48') extending from the front part of the plug (42) are electrically connected to a printed circuit board connector (60) mounted on a printed circuit board (61) in the antenna housing (40) (See FIG. 2).

The housing (40) has an opening (68) (See FIG. 5) through which the socket (4) is received. The sleeve (62) of the plug (42) abuts the edge of the opening (68) such that the internal surface of the sleeve (62) is a continuation of the internal surface of the opening (68). The housing (40) has a second recess (70) (See FIG. 5) within which is received the adapter (8). The second recess (70) has in internal surface which is cylindrical except for a flat orientation surface (72) and which closely fits the external surface of the front portion of the adapter (8). Thus, the adapter (8) can be received within the recess (70) of the antenna housing (40) in only one predetermined orientation, which enables the plug (4) to engage the socket (42) in the correct orientation. It should be noted that the adapter (8) fits snugly within the recess (70) and being made from a resilient rubber material will provide a circumferential seal around the entire circumference of the adapter (8) along the entire length $\epsilon$ of the recess (70) (See FIG. 5). This forms an environmental seal of the arrangement according to the present invention.

Figure 7:
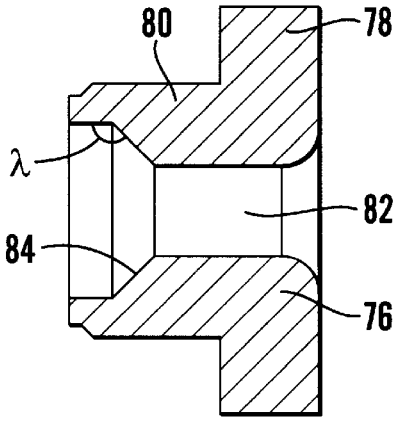
FIG. 7 shown a cross-sectional view of a screw used in the arrangement of FIGS. 1 and 2.
Figure 8:
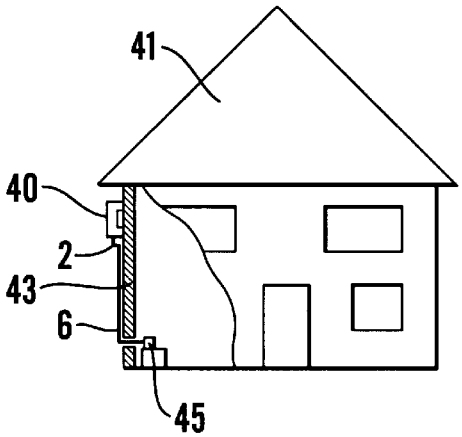
FIG. 8 shows a building with part of its wall cut away with an antenna housing mounted thereon.

The recess (70) opens into a screw threaded opening (74) in the antenna housing (40). Within this screw threaded opening is received a screw (76) (shown in cross-section in FIG. 7) having a flanged portion (78) and an externally threaded cylindrical portion (80). A channel (82) extends through the screw (76) through which the cable (6) extends. The internal surface of the front portion of the screw (76) has a conical portion (84) which is angled more steeply than the chamfer (26) on the adapter (8) and the end portions of the fingers (36). That is, angle $\lambda$ in FIG. 7 is smaller than angles $\alpha$ in FIGS. 3 and 4. Thus, when the screw (76) is screwed into the opening (74) so that the front surface of the flange (76) abuts a rim surrounding the opening (74), the conical portion (84) of the screw (76) engages the end portions (36) of the resilient fingers (32). Partly because of the different angle of taper of the conical surface (84) and fingers (32) and chamfer (26), the conical surface (84) of the screw (76) urges the end portions (36) of the fingers (32) to clamp the resilient external surface of the covering of the cable (6) and so provide cable strain relief and to reinforce the circumferential seal between the sealing portion (20) and the cable (6).

The arrangement according to the present invention is assembled as follows.

The cable (6) is passed through the channel (82) in the screw (76), through the clamp (28) and through the tube like adapter (8). The eight wires, extending from the end (23) of the cable (6) are connected to the eight ports of the socket (4) as described above. The adapter (8) is then fitted over the socket (4) with the key (16) of the socket fitting in the keyway (10) of the adapter until the rear surface (22) of the socket (4) engages the internal shoulder (24) in the adapter (8). Then clamp (28) is fitted over the rear portion of the adapter so that the ring portion (30) engages the external shoulder (44) of the adapter (8) to form a sub-assembly.

The housing (40) has the socket (42) already secured within it.

The sub-assembly can now be slideably fitted into the recess (70) by simply aligning the flat orientation surface (12) of the adapter (8) with the flat orientation surface (72) of the recess (70). This can be done blindly, ie. without inspection by feel alone. Then because the socket (4) is aligned with respect to the adapter (8) by the key (16) and keyway (10) engagement, the socket (4) is aligned with and slideably fits into the sleeve (62) of the plug (42) and the pins (48) extending from the rearward surface (52) of the plug (42) are aligned with and fit into the holes (56) in the socket (4) in order to electrically connect the eight wires in the cable (6) with the eight pins (48) of the socket (42). The sealing fit of the adapter (8) in the recess (70) provides a seal along the entire length $\epsilon$ of the recess (70).

The screw (76) is then screwed into the opening (74) and the conical surface (84) engages the fingers (32) of the clamp (28) as described above in order to clamp the cable (6). This provides strain relief for the cable. When the cable (6) is clamped in place an axial withdrawal force of several tens of Newtons on the cable in the direction of arrow (C) can be resisted by the clamp (28). Thus, the wires within the cable will not be pulled from the socket (4) as a result of strain on the cable (6).

Furthermore, the engagement of the conical surface (84) of the screw (76) on the fingers (32) of the clamp (28) causes the clamp (28) to press the seal portion (20) of the adapter (8) so that it seals tightly against the external surface of the cable (6). The rearward portion of the adapter (8) has relatively thin cylindrical walls which gives the rearward portion of the adapter (8) (which is made of a resilient plastics material) sufficient resilience to enable its sealing engagement with the cable (6) to be reinforced.

As described above the adapter (8) ensures the alignment of the socket (4) with the plug (42). It provides a bearing surface for the strain relief clamp (28). Finally, the adapter provides an environmental seal for the arrangement according to the present invention. This is because the internal surface of the adapter (8) engages the resilient external surface of the cable (6) at sealing portion (20) and the external surface of the adapter engages the internal surface of the recess (70) of the antenna housing (40). The seal between the cable (6) and the adapter (8) is further protected from poor environmental conditions by the fingers of the clamp (28) and the long narrow gap between the internal channel of the screw (76) and the cable (6). The seal between the adapter (8) and the recess (70) is further protected from poor environmental conditions by the screw threaded connection between the screw (76) and the opening (74).

The plug (42) and socket (4) may be standard multi-port connectors, for example based upon an established DIN41612 connector standard. The simple and low cost arrangement according to the present invention and as described above converts these standard connectors to a connection which can withstand poor environmental conditions, such as poor weather conditions.

In the above the entire adapter (8) may be made of a resilient plastics material. However, only parts of the adapter (8) need to be resilient, namely the sealing portion (20) and at least part of the external surface of the adapter (8) which engages the internal surface of the recess (70) of the antenna housing (40). For example, as shown by dotted line (90) in FIG. 3, the front part of the housing (to the left of the dotted line) may be made of rigid material and the remainder of the housing (to the right of the dotted line) may be made of resilient plastics material, such as a rubber material.

Figure 9:
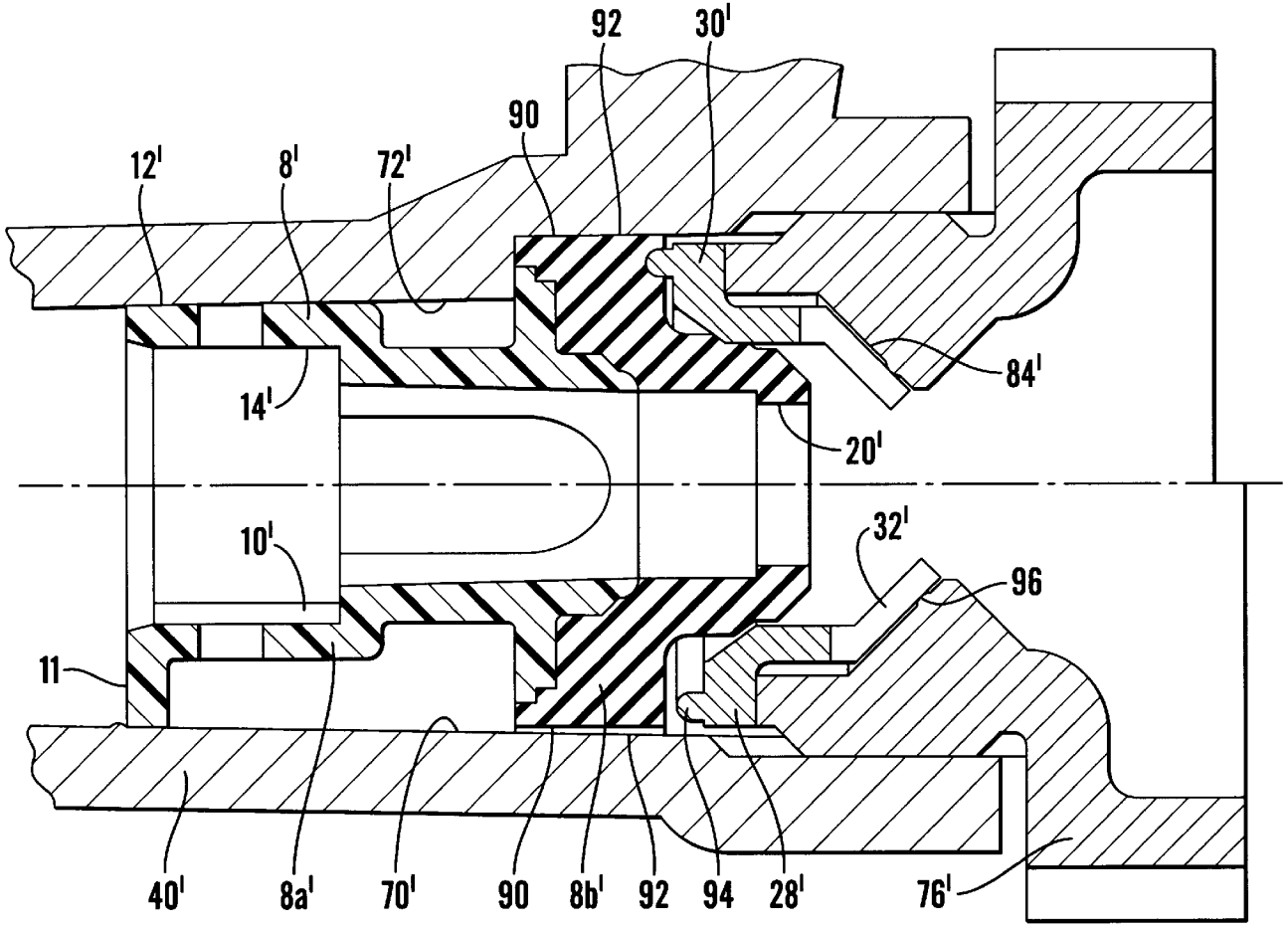
FIG. 9 shows a longitudinal cross-section of the adapter, cable clamp screw and receiving recess in an antenna housing of a weather proofing arrangement according to a second embodiment of the present invention.
Figure 10:
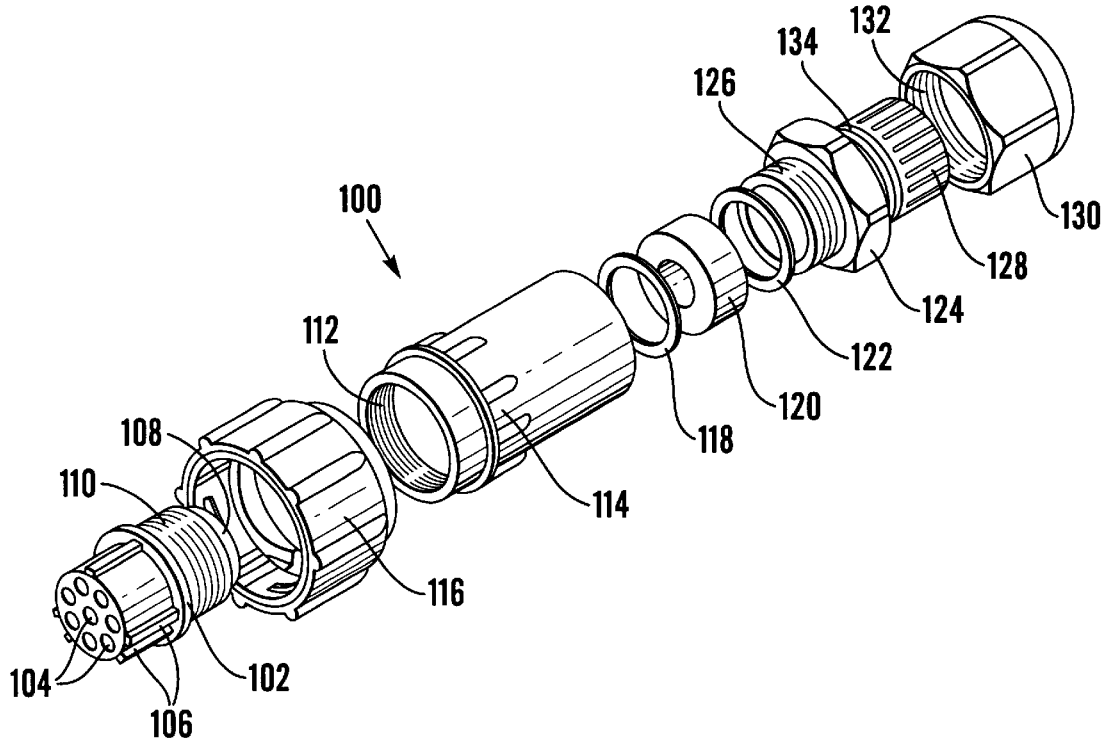
Fig. 10 Prior Art
FIG. 10 shows an exploded view of a multi-port electrical connector arrangement which forms part of the prior art for the present invention.

FIG. 9 shows an adapter (8'), cable clamp (28') and screw (76') of an alternative embodiment of the present invention fitted into a receiving recess (70') of an antenna arrangement (40'). A similar plug (4), socket (42) and cable (6) as are described above in relation to FIGS. 1, 2, 6*a* and 6*b* would be used in relation to the adapter (8') and receiving recess (70') of FIG. 9.

The adapter (8') is formed in two parts, a forward part (8*a*') which is made of a rigid material, such as a rigid plastics material, and a rearward part (8*b*') which is made of a resilient material, such as a rubber material. The forward and rearward part are permanently fixed together for example by moulding the rearward part (8*b*') onto the forward part (8*a*').

As described in relation to FIGS. 1 and 2 above, the adapter (8') is tube like and has a through cavity with a forward portion (14') of increased internal diameter within which can be fitted a plug (4). The forward portion (14') is formed with a keyway (10') within which is received a key (16) of the plug (4) so that the plug can fit into the forward portion (14') of the cavity in the adapter in a single predetermined orientation.

The forward portion of the adapter (8') has a part annular rim (11) which is cut off across a chord of the outer circumference of the rim (11) in order to form a flat orientation surface (12'). The otherwise cylindrical recess (70') is formed with a cooperating flat orientation surface (72') so that the adapter (8') can be fitted into the receiving recess (70') provided in the antenna housing (40') in a single predetermined orientation in which the flat orientation surfaces (12') and (72') are aligned. Thus the forward part (8*a*') of the adapter (8') which is made of a rigid material ensures that the plug (4) can be fitted into a socked (42) housed in the antenna housing (40') in only one predetermined orientation in which the sockets (56) of the plug (4) are correctly aligned with the pins (48) of the socket (42).

The rearward part of the adapter (8*b*') has an external cylindrical surface (90) which forms a seal, when the connector of FIG. 9 is fitted to the antenna housing (40'), against a cylindrical recess portion (92) of the receiving recess (70'). The rearward part of the adapter (8*b*') also has an internal cylindrical surface (20') which seals against the outer surface of a cable (6) passing through it. The rearward part of the adapter (8*b*') is made of a resilient material and the seals at the outer surface (90) and inner surface (20') of the adapter part (8*b*') are reinforced by the screw (76') and cable clamp (28') bearing against the rearward part of the adapter (8*b*'), as will be described below.

The cable clamp (28') shown in FIG. 9 is similar to that described above in relation to FIGS. 1, 2 and 4, having a rim (30') and a plurality of resilient fingers (32'), except that a forwardly facing annular lip (94) is provided on the rim (30'). Also, the screw (76') is similar to that described above in relation to FIGS. 1, 2 and 7, except that the internal sloping conical surface (84') extends further towards the axis of the screw (76') than it does in the screw (76) shown in FIGS. 1, 2 and 7. Also, an annular lip (96) is provided on the extended conical surface (84') for bearing against the fingers (32') of the cable clamp (28'), as will be described below.

To assemble the arrangement shown in FIG. 9, a cable (6) is threaded through the screw (76'), the cable clamp (28') and the adapter (8'). A plug (4) is then fitted to the multiple wires of the cable (6) as has been described above. Then the plug (4) is fitted into the forward portion (14') of the adapter (8') in a single predetermined orientation in which key (16) provided on the plug (4) is received within keyway (10') provided in the forward portion (14'). Then the adapter (8') is inserted into the receiving recess (70') of the antenna housing (40') in a single predetermined orientation in which the flat orientation surface (12') of the adapter (8') and the flat orientation surface (72') of the recess (70') are aligned. In this way the plug (4) is correctly aligned with respect to a socket (42) in the antenna housing (40') and the two are electrically connected. Then the cable clamp (28') is pulled over the rearward part of the adapter (8') and the screw (76') is partly screwed into the position shown in the lower half of FIG. 9.

The screw (76') is tightened up fully into the position showed in the top half of FIG. 9 and as can be seen, the lip (94) of the rim of the cable clamp (28') engages the rear surface of the resilient rearward part (8*b*') of the adapter (8') to deform the adapter part (8*b*') in order to reinforce the sealing engagement between the outer surface (90) of the adapter (8') and the inner surface (92) of the recess (70') of the antenna housing (40'). Also the annular lip (96) on the extended inner surface (84') of the screw (76') engages the resilient fingers (32') of the cable clamp (28') to urge them axially inwards to reinforce the clamping action between the fingers (32') and a cable (6) passing through the cable clamp (28'). The resilient fingers (32') act on the resilient rearward part of the adapter (**8*b'*) to deform it and reinforce the seal between the surface (20') of the adapter and the outer surface of a cable (6**).

Thus, alignment of the plug (4) and socket (42) is provided by the forward part of the adapter (**8*a*) and environmental sealing between the antenna housing (40') and the cable (6) is provided by the rearward part of the adapter (8*b'***).

What is claimed is:

1. An arrangement for protecting a multi-port electrical connection between a component and a cable from its environment, comprising: a first electrical connection part connected to the cable and a second electrical connection part, forming the multi-port connection; a housing part for housing the component; and a single piece tube like adapter having:

a non-uniform internal cross-sectioned portion in which the first electrical connection part is received in a single predetermined orientation;

an internal circumferential seal for sealing against the cable passing through said adapter;

an external surface portion of non-uniform cross-section locatable within a receiving recess of the housing part in a single predetermined orientation; and an external circumferential seal for sealing against a part of the receiving recess, and further comprising an opening in the housing part through which the adapter is received; and a fixing member fixed in the opening; wherein the second electrical connection part is received in the housing and the adapter is fixed within the housing part such that the internal circumferential seal is within the housing, so as to align the first electrical connection part with respect to the second electrical connection and so as to provide an environmental seal between the cable and the housing part.

2. An arrangement according to claim 1 wherein the non-uniform internal cross-sectioned portion of the adapter defines a keyway for receiving a co-operating key on the first electrical connector.

3. An arrangement according to claim 1 wherein the external surface portion of non-uniform cross-section defines an non-uniform orientation surface locatable in a single predetermined orientation within the receiving recess of the housing part which itself has a co-operating non-uniform orientation surface.

4. An arrangement according to claim 1 wherein at least the internal circumferential seal of the adapter is made of a resilient material.

5. An arrangement according to claim 1 wherein at least the external circumferential seal of the adapter is made of a resilient material.

6. An arrangement according to claim 1 additionally comprising a strain relief clamp engaging the cable passing through the adapter and additionally engaging a portion of the adapter comprising the internal circumferential seal to deform the portion to seal against the cable.

7. An arrangement according to claim 1 additionally comprising a strain relief clamp engaging the cable passing through the adapter and additionally engaging a portion of the adapter comprising the internal circumferential seal to deform the portion to seal against the cable, wherein the strain relief clamp comprises a plurality of resilient fingers.

8. An arrangement according to claim 1 additionally comprising a strain relief clamp and wherein, when the fixing member is fixed in the opening, the strain relief clamp is urged by the fixing member to engage and clamp in place the cable passing through the adapter and to additionally engage the portion of the adapter comprising the inner circumferential seal to urge the portion to seal against the cable.

9. An arrangement according to claim 1 additionally comprising a strain relief clamp and wherein, when the fixing member is fixed in the opening, the strain relief clamp is urged by the fixing member to engage and clamp in place the cable passing through the adapter and to additionally engage the portion of the adapter comprising the internal circumferential seal to urge the portion to seal against the cable passing through the adapter wherein the strain relief clamp comprises a plurality of resilient fingers for engaging and clamping in place the cable passing through the adapter.

10. An arrangement according to claim 1 additionally comprising a strain relief clamp engaging the cable passing through the adapter and additionally engaging a portion of the adapter comprising the external circumferential seal to deform the portion to seal against the receiving recess of the housing part.

11. An arrangement according to claim 1 additionally comprising a strain relief clamp and wherein, when the fixing member is fixed in the opening, the strain relief clamp is urged by the fixing member to engage and clamp in place the cable passing through the adapter and to additionally engage the portion of the adapter comprising the outer circumferential seal to urge the portion to seal against the receiving recess of the housing part.

12. An arrangement according to claim 1 wherein the housing part forms part of an externally mountable antenna.

13. A method of assembling an arrangement for housing a multi-port electrical connection between a component housed in a housing part and a cable from its environment, comprising the steps of;

threading the cable through a tube like adapter, electrically connecting the cable to a first electrical connection part, locating the first electrical connection part within the adapter in a pre-determined orientation defined by a non-uniform internal cross sectioned portion of the adapter and a co-operating non-uniform external cross sectioned portion of the first electrical connector, receiving the adapter through an opening in the housing part so as to locate the adapter within a recess in the housing part in a predetermined orientation defined by a non-uniform external surface portion of the adapter and a non-uniform internal surface portion of the recess, and fixing a fixing member in the opening, said located adapter having an external circumferential seal for sealing against an internal surface portion of the recess and an internal circumferential seal within the housing for sealing against the cable.

14. A method according to claim 13 additionally comprising the step of threading the cable through a strain relief clamp such that the clamp engages the cable and engages the portion of the adapter comprising the internal circumferential seal to urge the adapter to seal against the cable.

15. A method according to claim 13 additionally comprising the step of threading the cable through a strain relief clamp such that the clamp engages the cable and engages the portion of the adapter comprising the external circumferential seal to urge the adapter to seal against the receiving recess.

16. A method according to claim 13 additionally comprising the steps of;

threading the cable through a strain relief clamp, threading the cable through the fixing member, and fixing the fixing member in the opening such that the fixing member urges the strain relief clamp to engage and clamp the cable and to engage the portion of the adapter which comprises the internal circumferential seal to urge the adapter to seal against the cable.

17. A method according to claim 13 additionally comprising the steps of;

threading the cable through a strain relief clamp, threading the cable through the fixing member, and fixing the fixing member in the opening such that the fixing member urges the strain relief clamp to engage and clamp the cable and to engage the portion of the adapter which comprises the external circumferential seal to urge the adapter to seal against the receiving recess.

* * * * *